US005574003A

United States Patent [19]

Johnston

[11] Patent Number: 5,574,003

[45] **Date of Patent: *Nov. 12, 1996**

[54] DETERGENT COMPOSITIONS INHIBITING DYE TRANSFER IN WASHING

[75] Inventor: James P. Johnston, Overijse, Belgium

[73] Assignee: The Procter & Gamble Company, Cincinnati, Ohio

[ * ] Notice: The term of this patent shall not extend beyond the expiration date of Pat. No. 5,445,651.

[21] Appl. No.: 466,024

[22] Filed: Jun. 6, 1995

Related U.S. Application Data

[63] Continuation of Ser. No. 211,691, filed as PCT/US92/08531, Oct. 17, 1992, abandoned.

[30] Foreign Application Priority Data

Oct. 14, 1991 [JP] Japan ..... 3-20265516

[51] Int. Cl.[6] ..... C11D 3/386; C11D 3/395

[52] U.S. Cl. ..... 510/301; 510/305; 510/320; 510/392; 8/111; 8/137

[58] Field of Search ..... 252/94, 95, 186.1, 252/174.12, 104, DIG. 12; 8/107, 111, 137

[56] References Cited

U.S. PATENT DOCUMENTS

| | | | |
|---|---|---|---|
| 3,916,652 | 11/1975 | Speakman | 68/13 R |
| 3,927,967 | 12/1975 | Speakman | 8/103 |
| 4,077,768 | 3/1978 | Johnston et al. | 8/107 |
| 4,240,920 | 12/1980 | de Luque | 252/99 |
| 4,256,598 | 3/1981 | Sakkab | 252/99 |
| 4,892,941 | 1/1990 | Dolphin et al. | 540/145 |
| 5,071,439 | 12/1991 | Weible | 8/111 |
| 5,153,161 | 10/1992 | Kerschner et al. | 502/167 |
| 5,194,416 | 3/1993 | Jureller et al. | 502/167 |
| 5,445,651 | 8/1995 | Thoen et al. | 8/111 |

FOREIGN PATENT DOCUMENTS

| | | | |
|---|---|---|---|
| 0369678 | 5/1990 | European Pat. Off. . | |
| 0384503 | 8/1990 | European Pat. Off. . | |
| 0384503A1 | 8/1990 | European Pat. Off. | C11D 3/395 |
| 0458397A2 | 11/1991 | European Pat. Off. | C11D 3/395 |
| 0509787A2 | 10/1992 | European Pat. Off. | C11D 3/39 |
| 1225713 | 3/1971 | United Kingdom . | |

*Primary Examiner*—Paul Lieberman
*Assistant Examiner*—Lorna M. Douyon
*Attorney, Agent, or Firm*—George W. Allen; T. David Reed

[57] ABSTRACT

A dye transfer inhibiting compositions are disclosed, comprising:

A. an iron catalyst selected from a) iron porphin and water-soluble or water-dispersable derivatives thereof;

b) iron porphyrin and water-soluble or water-dispersable derivatives thereof;

c) iron phthalocyanine and water-soluble or water-dispersable derivatives thereof;

B. an enzymatic system capable of generating hydrogen peroxide.

8 Claims, No Drawings

DETERGENT COMPOSITIONS INHIBITING DYE TRANSFER IN WASHING

This is a continuation of application Ser. No. 08/211,691, filed as PCT/US92/08531, Oct. 17, 1992, now abandoned.

FIELD OF THE INVENTION

The present invention relates to a composition and a process for inhibiting dye transfer between fabrics during washing.

BACKGROUND OF THE INVENTION

One of the most persistent and troublesome problems arising during modern fabric laundering operations is the tendency of some colored fabrics to release dye into the laundering solutions. The dye is then transferred onto other fabrics being washed therewith.

One way of overcoming this problem would be to bleach the fugitive dyes washed out of dyed fabrics before they have the opportunity to become attached to other articles in the wash.

Suspended or solubilized dyes can to some degree be oxidized in solution by employing known bleaching agents.

GB 2 101 167 describes a stable liquid bleaching composition containing a hydrogen peroxide precursor which is activated to yield hydrogen peroxide on dilution.

However it is important at the same time not to bleach the dyes actually remaining on the fabrics, that is, not to cause color damage.

U.S. Pat. No. 4,077,768 describes a process for inhibiting dye transfer by the use of an oxidizing bleaching agent together with catalytic compounds such as iron porphins.

Yet, the effectiveness of the process tends to be limited particularly in that way that the oxidizing bleaching agent has to be added dropwise in order to obtain the most effective dye transfer inhibition.

The present invention therefore provides an efficient dye transfer inhibiting composition which overcomes this limitation and provides a practical way of controlling a low steady state level of hydrogen peroxide.

The hydrogen peroxide is enzymatically generated in situ by using a hydrogen peroxide precursor plus an oxidase enzyme e.g. glucose or alcohol as hydrogen precursors and respectively glucose oxidase or alcohol oxidase as the enzyme system.

SUMMARY OF THE INVENTION

The present invention relates to inhibiting dye transfer compositions comprising an enzymatic system capable of generating hydrogen peroxide and iron catalysts selected from a) iron porphin and water-soluble or water-dispersable derivatives thereof:

b) iron porphyrin and water-soluble or water-dispersable derivatives thereof;

c) iron phthalocyanine and water-soluble or water-dispersable derivatives thereof;

According to another embodiment of this invention a process is also provided for laundering operations involving colored fabrics.

DETAILED DESCRIPTION OF THE INVENTION

The present invention provides a dye transfer inhibiting composition comprising an enzymatic system capable of generating hydrogen peroxide and iron catalysts selected from a) iron porphin and water-soluble or water-dispersable derivatives thereof;

b) iron porphyrin and water-soluble or water-dispersable derivatives thereof;

c) iron phthalocyanine and water-soluble or water-dispersable derivatives thereof;

The preferred usage range of the catalyst in the wash is $10^{-6}$ molar to $10^{-4}$ molar.

The essential iron porphin structure may be visualized as indicated in Formula I in the accompanying drawings. In Formula I the atom positions of the porphin structure are numbered conventionally and the double bonds are put in conventionally. In other formula, the double bonds have been omitted in the drawings, but are actually present as in I.

Preferred iron porphin structures are those substituted at one or more of the 5, 10, 15 and 20 carbon positions of Formula I (Meso positions), with a substituent selected from the group consisting of

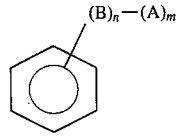

and

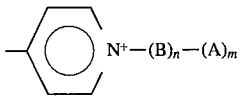

wherein n and m may be 0 or 1; A may be sulfate, sulfonate, phosphate or carboxylate groups; and B is $C_1$–$C_{10}$ alkyl, polyethoxy alkyl or hydroxy alkyl.

Preferred molecules are those in which the substituents on the phenyl or pyridyl groups are selected from the group consisting of $—CH_3$, $—C_2H_5$, $—CH_2CH_2CH_2SO_3—$, $—CH_2—$, and $—CH_2CH(OH)CH_2SO_3—$, $—SO_3$ A particularly preferred iron phorphin is one in which the molecule is substituted at the 5, 10 15, and 20 carbon positions with the substituent

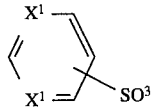

This preferred compound is known as ferric tetrasulfonated tetraphenylporphin. The symbol $X^1$ is (=CY—) wherein each Y, independently, is hydrogen, chlorine, bromine or meso substituted alkyl, cycloalkyl, aralkyl, aryl, alkaryl or heteroaryl.

The symbol $X^2$ of Formula I represents an anion, preferably $OH^-$ or $Cl^-$. The compound of Formula I may be substituted at one or more of the remaining carbon positions with $C_1$–$C_{10}$ alkyl, hydroxyalkyl or oxyalkyl groups.

(I)

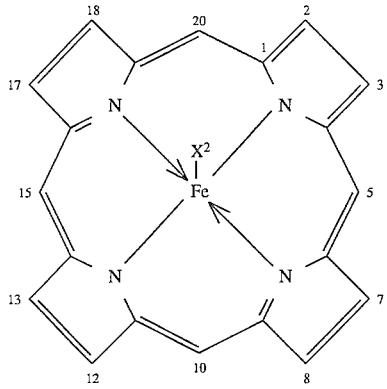

Iron porphyrin and water-soluble or water-disposable derivatives thereof have a structure given in formula II.

(II)

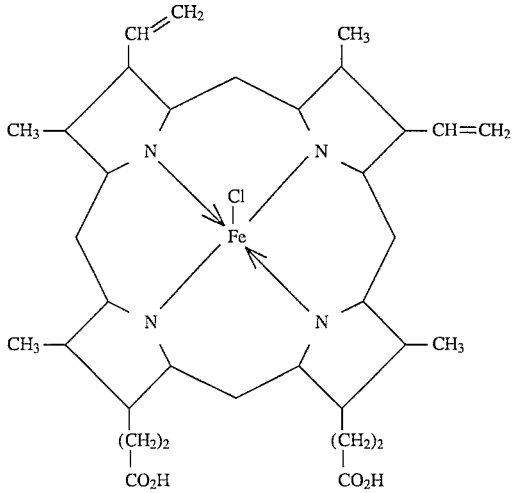

The symbol $X^2$ of Formula II represents an anion, preferably $OH^-$ or $CL^-$.

Iron phthalocyanine and derivatives have the structure indicated in Formula III, wherein the atom positions of the phthalocyanine structure are numbered conventionally. The anionic groups in the above structures contain cations selected from the group consisting of sodium and potassium cations or other non-interfering cations which leave the structures water-soluble. Preferred phthalocyanine derivatives are Fe(III) phthalocyanine trisulfonate and Fe(III) phthalocyanine tetrasulfonate.

(III)

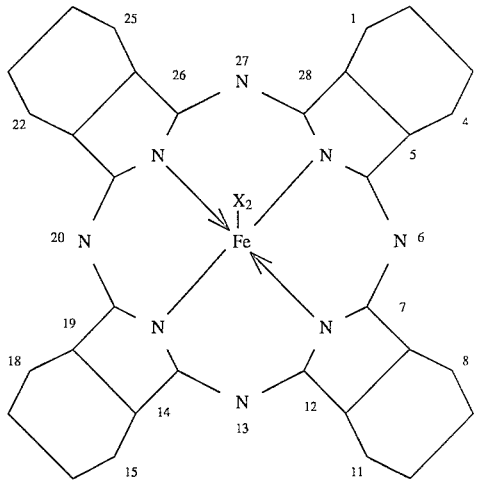

Another form of substitution possible for the present invention is substitution of Fe by Mn or Co.

Still a number of considerations are significant in selecting variants of or substituents in the basic porphin or azaporphin structure. In the first place, one would choose compounds which are available or can be readily synthesized.

Beyond this, choice of the substituent groups can be used to control the solubility of the catalyst in water or in detergent solutions. Yet again, especially where it is desired to avoid attacking dyes attached to solid surfaces, the substituents can control the affinity of the catalyst compound for the surface. Thus, strongly negatively charged substituted compounds, for instance the tetrasulfonated porphin, may be repelled by negatively charged stains or stained surfaces and are therefore most likely not to cause attack on fixed dyes, whereas the cationic or zwitterionic compounds may be attracted to, or at least not repelled by such stained surfaces.

HYDROGEN PEROXIDE PRECURSOR

The dye transfer inhibiting agent, hydrogen peroxide is generated in situ by using an enzymatic hydrogen peroxide generation system.

The use of an enzymatic hydrogen peroxide generating system allows the continuous generation of low levels of hydrogen peroxide and provides a practical way of controlling a low steady-state level of hydrogen peroxide. Maximum effectiveness occurs when the component levels are such that the hydrogen peroxide is replenished at a rate similar to its removal from interaction with dyes in the wash water.

The enzyme used in the present invention is an oxidase.

Suitable oxidases include those which act on aromatic compounds such as phenols and related substances, e.g. catechol oxidases, laccase.

Other suitable oxidases are urate oxidases, galactose oxidase, alcohol oxidases, amine oxidases, amino acid oxidase, amyloglucosidase and cholesterol oxidase.

The preferred enzymatic systems are alcohol and aldehyde oxidases.

The more preferred systems for granular detergent application would have solid alcohols e.g. glucose whose oxidation is catalysed by glucose oxidase to glucoronic acid with the formation of hydrogen peroxide.

The more preferred systems for liquid detergent application would involve liquid alcohols which could also act as, for example solvents. An example is ethanol/ethanol oxidase.

The quantity of oxidase to be employed in compositions according to the invention should be at least sufficient to provide a constant generation of 0.01 to 10 ppm AvO per minute in the wash. Generally, the oxidase will be present to the extent of from 0.1 to 1100 units per ml or per gram of composition. For example, with the glucose oxidase, this can be achieved at room temperature and at pH 6 to 11, preferentially 7 to 9 with 50–5000 U/l glucose oxidase, 0.005 to 0.5% glucose under constant aeration.

ADJUNCTS

Composition of the present can contain the usual components of such detergent compositions in the usual amounts. Thus, organic surfactants anionic, nonionic, ampholytic, or zwitterionic or less usually cationic and mixtures thereof, may be present. Suitable surfactants are well known in the art and an extensive list of such compounds is given in U.S. Pat. No. 3,717,630 and in U.S. patent application Ser. No. 589,116.

Detergent compositions useful in the present invention contain from 1 to 95%, preferable from 5 to 40% of a nonionic, anionic, zwitterionic, or mixtures thereof. Detergency builders, whether inorganic or organic, phosphatic or not, water-soluble or insoluble, and other water-soluble salts may be present, and salts of this sort may be employed whether organic detergents are present or not. A description of suitable builders is given in U.S. Pat. No. 3,936,537 and in U.S. patent application Ser. No. 589,116. Detergent builders are present from 0 to 50%, preferably from 5 to 40%.

The compositions of the present invention should be free from conventional bleaching agents. Other components used in detergent compositions may be employed, such as suds boosting or depressing agents, enzymes and stabilizers or activators, soil-suspending agents soil-release agents, optical brighteners, abrasives, bactericides, tarnish inhibitors, coloring agents, and perfumes.

These components, particularly the enzymes, optical brighteners, coloring agents, and perfumes, should preferably be chosen such that they are compatible with the bleach component of the composition.

The detergent compositions according to the invention can be in liquid, paste or granular forms. Granular compositions according to the present invention can also be in "compact form" i.e. they may have a relatively higher density than conventional granular detergents, i.e. from 550 to 950 g/l; in such case, the granular detergent compositions according to the present invention will contain a lower amount of "inorganic filler salt", compared to conventional granular detergents; typical filler salts are alkaline earth metal salts of sulphates and chlorides, typically sodium sulphate; "compact" detergents typically comprise not more than 10% filler salt.

The present invention also relates to a process for inhibiting dye transfer from one fabric to another of solubilized and suspended dyes encountered during fabric laundering operations involving colored fabrics.

The process comprises contacting fabrics with a laundering solution as hereinbefore described.

The process of the invention is conveniently carried out in the course of the washing process. The washing process is preferably carried out at 5° C. to 75° C., especially 20 to 60, but the catalysts are effective at up to 95° C. The pH of the treatment solution is preferably from 7 to 11, especially from 7.5 to 10.5.

The process and compositions of the invention can also be used as additive during laundry operations.

The following examples are meant to exemplify compositions of the present invention, but are not necessarily meant to limit or otherwise define the scope of the invention, said scope being determined according to claims which follow.

EXAMPLE I

Homogeneous Polar Blue (Color Index 61135) Bleaching.

A solution (100 ml) of Polar Brilliant Blue dye ($6\times10^{-5}$M) and a ferric tetrasulfonated tetraphenylporphin catalyst ($1\times10^{-5}$M) was made. Its pH value was adjusted to pH 8.1. The absorbance of this solution at 620 mm, a measure of the Polar Blue dye concentration was 0.765 in a 1 cm cell. Glucose (0.1%) and glucose oxidase (2.7 U/ml) were added to the aerated solution. After 15 min. the absorbance at 620 mm of the resultant solution decreased to 0.28. This corresponds to almost total oxidation of the Polar Blue dye. Blank experiments indicated no oxidation of Polar Blue dye occurred over the same time period (as evidenced by no changes in absorbance at 620 mm)

(a) in absence of catalyst or,
(b) in absence of glucose or
(c) in absence of glucose oxidase

EXAMPLE II

Small scale washing tests.

Tracer cloths (5 cm×5 cm) stained with Durasol Red dye (CI 28860) and white terry towel swatches (5 cm×5 cm) were washed together at pH 8.1 for 45 min. at 25° C. with 10 ppm Fe(III) TPPS. In addition there were added in various treatments.

(a) nothing
(b) 0.1% glucose
(c) 2.7 U/ml glucose oxidase
(d) 0.1% glucose+2.7 U/ml glucose oxidase It was observed that after treatments (a), (b) and (c) that the test fabrics were clearly colored pink. After treatment (d) no visible coloring had transferred. It was also observed that the stained swatches of treatment (d) were not discoloring, demonstrating that dyes on the fabrics are not attacked.

EXAMPLE III

A liquid detergent composition according to the present invention is prepared, having the following compositions:

| | |
|---|---|
| Linear alkylbenzene sulfonate | 10 |
| Alkyl sulphate | 4 |

-continued

| | |
|---|---|
| Fatty alcohol ($C_{12}$–$C_{15}$) ethoxylate | 12 |
| Fatty acid | 10 |
| Oleic acid | 4 |
| Citric acid | 1 |
| NaOH | 3.4 |
| Propanediol | 1.5 |
| Ethanol | 10 |
| Ethanoloxidase | 270 u/ml |
| Ferric tetrasulfonated tetraphenylporphin | 0.1 |
| Minors | up to 100 |

EXAMPLE IV

A compact granular detergent composition according to the present invention is prepared, having the following formulation:

| | |
|---|---|
| Linear alkyl benzene sulphonate | 11.40 |
| Tallow alkyl sulphate | 1.80 |
| $C_{45}$ alkyl sulphate | 3.00 |
| $C_{45}$ alcohol 7 times ethoxylated | 4.00 |
| Tallow alcohol 11 times ethoxylated | 1.80 |
| Dispersant | 0.07 |
| Silicone fluid | 0.80 |
| Trisodium citrate | 14.00 |
| Citric acid | 3.00 |
| Zeolite | 32.50 |
| Maleic acid actylic acid copolymer | 5.00 |
| DETMPA | 1.00 |
| Cellulase (active protein) | 0.03 |
| Alkalase/BAN | 0.60 |
| Lipase | 0.36 |
| Sodium silicate | 2.00 |
| Sodium sulphate | 3.50 |
| Ferric tetrasulfonated tetraphenylporphin | 0.10 |
| Glucose | 10.00 |
| Glucose oxidase | 270 u/ml |
| Minors | up to 100 |

I claim:

1. A composition for inhibiting dye transfer in a wash, comprising:

a) an iron catalyst which is ferric tetrasulfonated tetraphenylporphin; wherein the concentration of said catalyst in the wash is $10^{-6}$ molar to $10^{-4}$ molar; and b) an enzymatic system capable of generating hydrogen peroxide, said enzymatic system comprising (i) an oxidase selected from the group consisting of glucose oxidase and ethanol oxidase, present in an amount of 0.1 to 1,000 units per ml or per gram of said compositions; and (ii) from 0.5 to 50% by weight of said composition of a substrate selected from the group consisting of glucose and $C_{1-4}$ alkanols.

2. A dye transfer inhibiting composition according to claim 1 wherein said substrate is glucose.

3. A dye transfer inhibiting composition according to claim 1 wherein said substrate consists of a $C_1$–$C_4$ alcohol.

4. A dye transfer inhibiting composition according to claim 3 wherein said substrate is ethanol.

5. A dye transfer inhibiting composition according to claim 1 which yields hydrogen peroxide at a concentration from 0.01 to 10 ppm/min.

6. A process for inhibiting dye transfer between fabrics during laundering operations involving colored fabrics, said process comprising contacting said fabrics with a laundering solution containing a dye transfer inhibition composition according to claim 1.

7. A process for inhibiting dye transfer according to claim 6 which is carried out at a temperature in the range of from 5° C. to 75° C.

8. A process for inhibiting dye transfer according to claim 6 wherein the pH of the bleaching bath is from 7 to 11.

* * * * *